US010233914B2

(12) United States Patent
Iammatteo et al.

(10) Patent No.: US 10,233,914 B2
(45) Date of Patent: Mar. 19, 2019

(54) VACUUM-DRIVEN FLUID DELIVERY DEVICE WITH CONTROLLED VACUUM PRESSURE RELEASE

(71) Applicant: Easy Spray LLC, Lake St. Louis, MO (US)

(72) Inventors: Pasquale A. Iammatteo, Holmdel, NJ (US); Roman Bicej, Ocean Township, NJ (US)

(73) Assignee: Easy Spray LLC, Lake St. Louis, MO (US)

( * ) Notice: Subject to any disclaimer, the term of this patent is extended or adjusted under 35 U.S.C. 154(b) by 190 days.

(21) Appl. No.: 15/261,423

(22) Filed: Sep. 9, 2016

(65) Prior Publication Data

US 2017/0074254 A1 Mar. 16, 2017

Related U.S. Application Data

(60) Provisional application No. 62/217,390, filed on Sep. 11, 2015.

(51) Int. Cl.

| | |
|---|---|
| ***B05B 7/14*** | (2006.01) |
| ***F04B 9/14*** | (2006.01) |
| ***F04B 23/02*** | (2006.01) |
| ***F04B 49/03*** | (2006.01) |
| ***F04B 53/10*** | (2006.01) |
| ***F04B 9/127*** | (2006.01) |
| ***F04B 9/137*** | (2006.01) |
| ***F04B 9/12*** | (2006.01) |

(52) U.S. Cl.

CPC ..... *F04B 23/028* (2013.01); *B05B 7/1468* (2013.01); *F04B 9/127* (2013.01); *F04B 9/1207* (2013.01); *F04B 9/137* (2013.01); *F04B 9/14* (2013.01); *F04B 49/03* (2013.01); *F04B 53/10* (2013.01)

(58) Field of Classification Search

CPC ..... F04B 9/1207; F04B 9/127; F04B 49/03; F04B 23/028; F04B 19/22; F04B 9/131; F04B 17/06; F04B 23/02; F04B 53/06; F04B 2201/0605; F04B 53/04; F04B 23/10; F04B 23/106; F04B 43/107; B05B 11/00; B05B 7/1468

See application file for complete search history.

(56) References Cited

U.S. PATENT DOCUMENTS 5,807,337 A * 9/1998 Yamada ..... A61M 5/14526 604/131
8,973,847 B2 * 3/2015 Iammatteo ..... B05B 11/3018 222/340
2005/0272549 A1 * 12/2005 Carne ..... F16H 57/04 475/116

(Continued)

*Primary Examiner* — Bryan M Lettman
*Assistant Examiner* — Timothy P Solak
(74) *Attorney, Agent, or Firm* — NSIP Law

(57) ABSTRACT

A fluid delivery device includes: a first chamber configured to receive fluid from a fluid reservoir; a second chamber configured generate a vacuum therein to apply pressure to the fluid in the first chamber to enable the fluid in the first chamber to be output from the fluid delivery device; and a flow control member configured to allow the fluid in the first chamber to flow through the flow control member into the fluid reservoir at a predetermined flow rate to decrease the vacuum in the second chamber.

8 Claims, 3 Drawing Sheets

(56) References Cited

U.S. PATENT DOCUMENTS

| | | | | |
|---|---|---|---|---|
| 2006/0086387 | A1* | 4/2006 | Gupta | G05D 7/0635<br>137/101.25 |
| 2008/0264261 | A1* | 10/2008 | Kavazov | A61J 1/2096<br>96/193 |
| 2010/0305507 | A1* | 12/2010 | Duncan | A61M 5/14526<br>604/121 |

* cited by examiner

VACUUM-DRIVEN FLUID DELIVERY DEVICE WITH CONTROLLED VACUUM PRESSURE RELEASE

CROSS-REFERENCE TO RELATED APPLICATIONS

This application claims the benefit under 35 USC 119(e) of U.S. Provisional Application No. 62/217,390 filed on Sep. 11, 2015, the entire disclosure of which is incorporated herein by reference for all purposes.

BACKGROUND

1. Field

The following description generally relates to vacuum-driven fluid delivery devices.

2. Description of Related Art

A vacuum-driven fluid delivery device outputs fluid under a force generated by a vacuum in a vacuum chamber. An example of a vacuum-driven fluid delivery device is disclosed in U.S. Pat. No. 8,973,847 by lammatteo and Bicej, issued on Mar. 10, 2015, the entire disclosure of which is incorporated herein by reference for all purposes. When such a fluid delivery device remains unused with a volume of vacuum in the vacuum chamber (i.e., in a "charged" state), the fluid delivery device is susceptible to loss of some or all of the volume of the vacuum over time. That is, external gases permeate into the vacuum chamber over time and replace at least a portion of the vacuum chamber that was previously occupied by the vacuum, thereby reducing the maximum vacuum volume of the vacuum chamber. Such a reduction in the maximum vacuum volume reduces the maximum duration of fluid output from the fluid delivery device.

Accordingly, it is desirable to provide a vacuum-driven fluid delivery device that prevents undesirable loss in maximum vacuum volume of the vacuum chamber during storage of the device in a charged state.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a fluid delivery device includes: a first chamber; a second chamber; a reservoir configured to contain a fluid; a first valve configured to control a first flow of the fluid between the fluid reservoir and the second chamber; a flow control member configured to control a second flow of the fluid between the second chamber and the fluid reservoir; a first plunger configured to generate a vacuum in the first chamber responsive to movement of the first plunger in a first direction; and a second plunger configured to move in the first direction in response to movement of the first plunger in the first direction to cause a portion of the fluid to flow from the fluid reservoir through the first valve and into the second chamber, and configured to apply a force generated by the vacuum to the portion of the fluid in the second chamber; and an outlet including a second valve configured to be actuated to output the portion of the fluid from the second chamber outside of the fluid delivery device, wherein, when the second valve is not actuated, the flow control member is configured to allow the portion of the fluid in the second chamber to flow through the flow control member into the fluid reservoir at a predetermined flow rate.

When flow control member is in a closed configuration, the flow control member may only partially blocks a flow of the portion of the fluid in the fluid chamber from the fluid chamber to the fluid reservoir.

The flow control member may include a fixed position valve.

The first valve may be configured to prevent the portion of the fluid in the second chamber from flowing out of the second chamber through the first valve. When the second valve is not actuated, the second valve may be biased to prevent the portion of the fluid in the fluid chamber from flowing out of the second chamber through the second valve.

In response to the portion of the fluid in the second chamber flowing through the flow control member into the fluid reservoir, the first plunger and the second plunger may move in a second direction opposite the first direction and the vacuum in the first chamber may decrease.

In another general aspect, a fluid delivery device includes: a first chamber configured to receive fluid from a fluid reservoir; a second chamber configured generate a vacuum therein to apply pressure to the fluid in the first chamber to enable the fluid in the first chamber to be output from the fluid delivery device; and a flow control member configured to allow the fluid in the first chamber to flow through the flow control member into the fluid reservoir at a predetermined flow rate to decrease the vacuum in the second chamber.

The fluid control member may include a fixed position valve.

The fixed position valve may be fixed in a closed position in which a flow of the fluid in the first chamber into the fluid reservoir through the valve is only partially restricted.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

The following description is provided to assist the reader in gaining a comprehensive understanding of the methods, apparatuses, and/or systems described herein. However, various changes, modifications, and equivalents of the methods, apparatuses, and/or systems described herein will be apparent to those of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of well-known functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Figure 1:
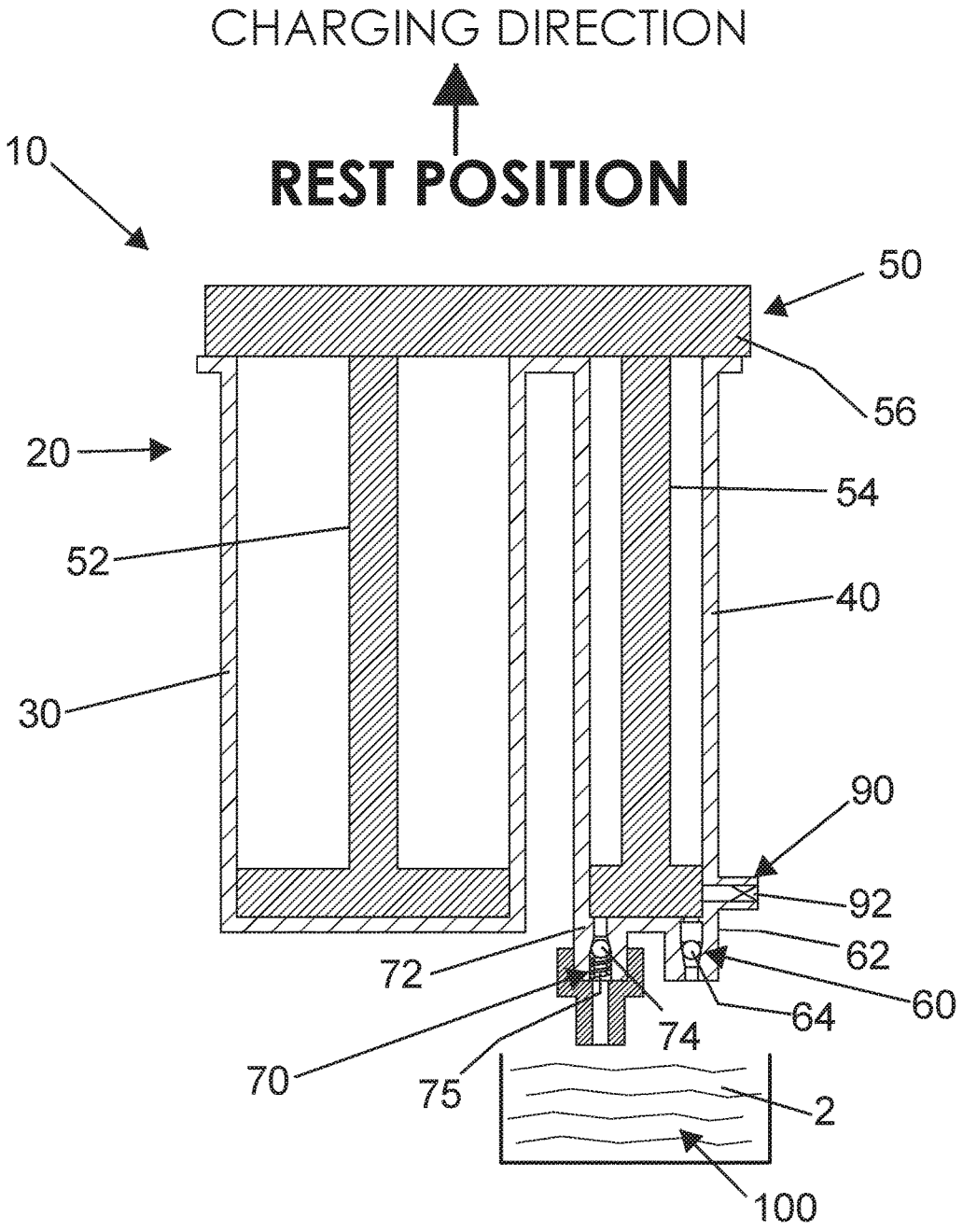
FIG. 1 is a side cross-sectional view of a vacuum-driven fluid delivery device in an uncharged state, according to an embodiment.
Figure 2:
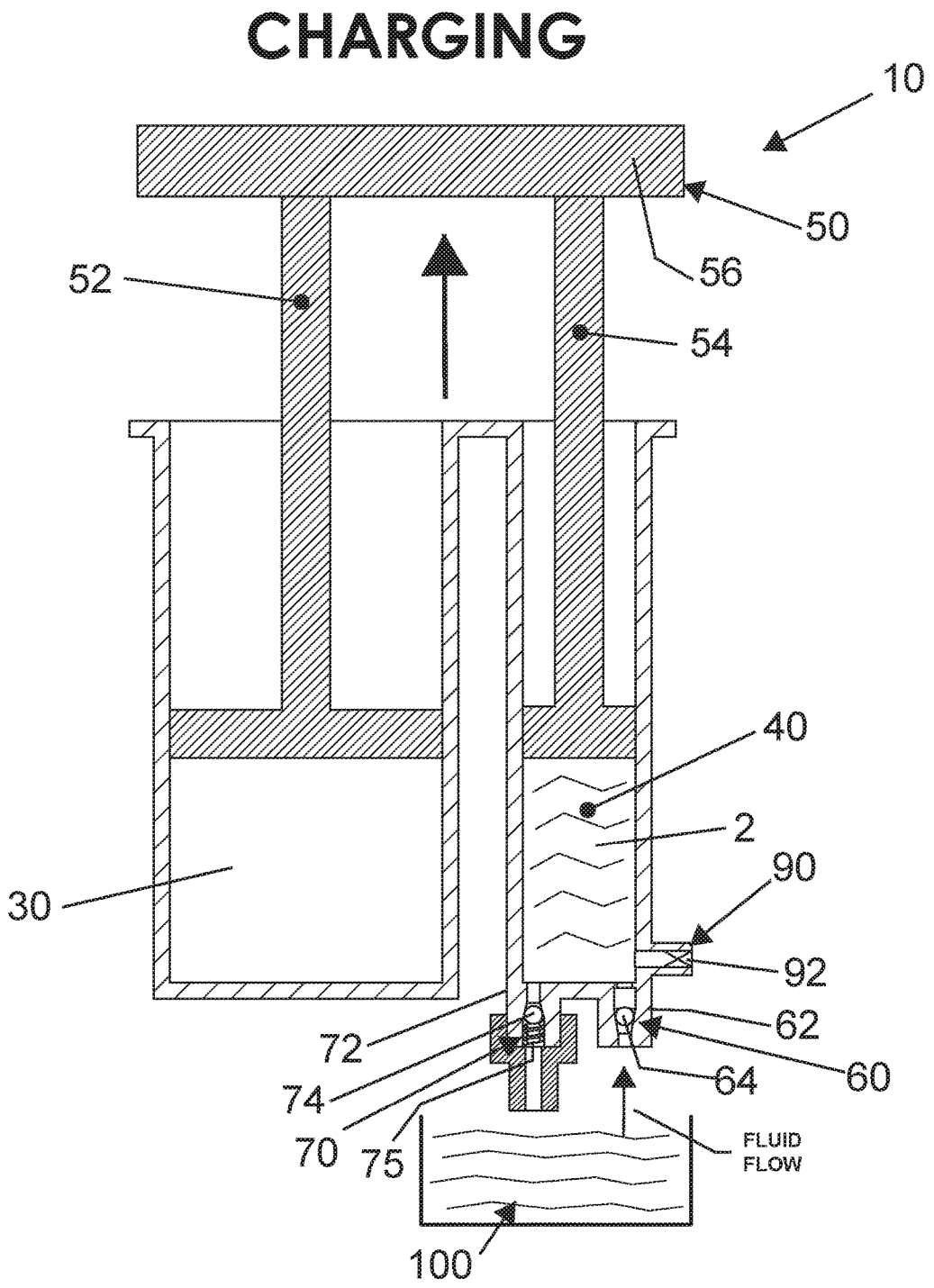
FIG. 2 is a side cross-sectional view of the vacuum-driven fluid delivery device in a charged state during a charging operation.
Figure 3:
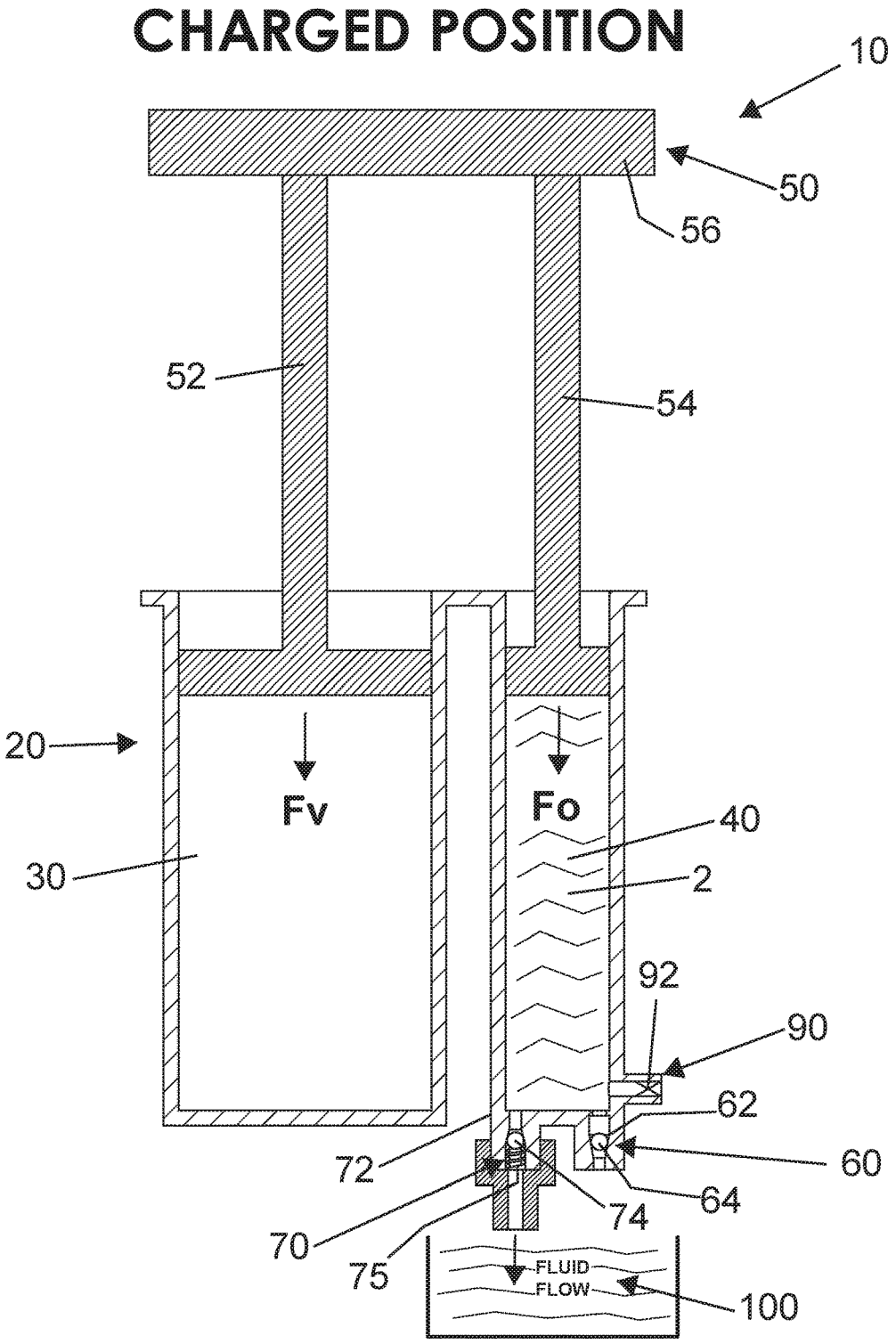
FIG. 3 is a side cross-sectional view of the vacuum-driven fluid delivery device in a fully charged state.

FIGS. 1-3 show a vacuum-driven fluid delivery device 10 according to an example embodiment. More specifically, FIG. 1 shows the fluid delivery device 10 in an uncharged or rest state in which the device is not configured to output fluid 2, FIG. 2 shows the fluid delivery device 10 in a partially charged state during a charging operation for preparing the device 10 to output fluid 2, and FIG. 3 shows the fluid delivery device 10 in a fully charged state in which the device 10 is configured to output fluid 2. The fluid 2 may be any liquid or gas, for example.

Referring to FIGS. 1-3, the fluid delivery device 10 includes a main body 20, a plunger assembly 50, a check valve 60, a flow control member 70, a fluid outlet 90, and a fluid reservoir 100 configured to store a volume of the fluid 2.

The main body 20 includes a vacuum chamber 30 configured to contain a vacuum and a fluid chamber 40 configured to receive fluid from the fluid reservoir 100. The plunger assembly 50 includes a vacuum plunger 52 configured to reciprocate within the vacuum chamber 30, a fluid plunger 54 configured to reciprocate within the fluid chamber 40, and a connecting member 56 connecting the vacuum plunger 52 and the fluid plunger 54 to each other. Due to their interconnection by the connecting member 56, the vacuum plunger 52 and the fluid plunger 54 may be configured to move together simultaneously. FIGS. 1-3 merely provide an example configuration of the plunger assembly 50, and other configurations are possible. For example, instead of being connected in a side-by-side configuration as shown, the vacuum plunger 52 and the fluid plunger 54 may be connected in a coaxial configuration.

The check valve 60 is in fluid communication with the fluid chamber 40 and the fluid reservoir 100, and is configured to control flow of the fluid 2 between the fluid reservoir 100 and the fluid chamber 40. The check valve 60 includes a tubular housing 62 and a sealing member (e.g., a ball member or stopper) 64 configured to reciprocate within the housing 62 to control the flow of the fluid between the fluid reservoir 100 and the fluid chamber 40. The sealing member 64 is biased towards a sealing position with an inner wall surface of the housing 62, in which the check valve 60 is in a closed configuration and the sealing member 64 prevents the flow of the fluid 2 between the fluid reservoir 100 and the fluid chamber 40.

As will be described in detail later, the sealing member 64 may be urged under fluid pressure into an unsealing position, in which the check valve 60 is in an open configuration and the sealing member 64 allows flow of the fluid 2 between the fluid reservoir 100 and the fluid chamber 40.

The flow control member 70 is in fluid communication with the fluid chamber 40 and the fluid reservoir 100, and is configured to control flow of the fluid 2 between the fluid chamber 40 and the fluid reservoir 100. The flow control member 70 is configured to enable limited flow of the fluid 2 from the fluid chamber 40 to the fluid reservoir 100, and is configured to prevent flow of the fluid 2 from the fluid reservoir 100 to the fluid chamber 40. The flow control member 70 may be a fixed position valve in which a sealing member 74 (e.g., a ball or stopper) is disposed in a housing 72 and biased in a sealing position to only partially restrict flow of the fluid 2 from the fluid chamber 40 to the fluid reservoir 100 through the flow control member 70. For example, the flow control member is fixed in a closed position in which the sealing member 74 is biased in a sealing position by a biasing member such as a spring 75 such that the sealing member 74 only partially restricts an interior fluid pathway of the flow control member 70. In other words, the sealing member 74 highly restricts/partially blocks flow of the fluid 2 from the fluid chamber 40 to the fluid reservoir 100 in the sealing position, but does not provide a completely fluid-tight seal.

Alternatively, the flow control member 70 may be an adjustable valve that may be adjusted to control the flow rate of the fluid 2 into the fluid reservoir 100 through the valve. Although the flow control member 70 is shown and described as a ball-and-spring or stopper-and-spring type valve, the flow control member 70 may be any other known type of fixed or adjustable position valve.

The fluid outlet 90 controls the output of the fluid 2 from the device 10. More specifically, as will be described later in more detail, the fluid outlet 90 includes an outlet valve 92 that is configured to control the flow of the fluid 2 out of the fluid chamber 40 through the fluid outlet 90. The outlet valve 92 is biased in a closed configuration to prevent the fluid 2 in the fluid chamber 40 from flowing out of the fluid outlet 90. The outlet valve 92 may be selectively actuated by an actuator in a known manner to be placed in a configuration in which the fluid 2 in the chamber is allowed to flow out of the fluid outlet 90. For example, the fluid outlet 90 may be connected to a spray nozzle (not shown) in a known manner such that actuation of the outlet valve 92 produces a spray of the fluid 2 outside of the device 10 from the nozzle.

The location and configuration of the fluid outlet 90 shown in FIGS. 1 and 2 merely correspond to one example. Other locations and configurations are possible. For example, the fluid outlet 90 may communicate with a hollow passage in the fluid plunger 54 or another passage in the fluid chamber 40 configured to allow the fluid 2 to flow into the fluid outlet 90.

As shown in FIG. 1, when the device 10 is in an uncharged state, and thereby not prepared to output fluid 2 through the fluid outlet 90, the vacuum plunger 52 and the fluid plunger 54 are at their lowermost positions of their strokes within the vacuum chamber 30 and the fluid chamber 40, respectively. Accordingly, the vacuum chamber 30 and the fluid chamber 40 have no volume or nearly no volume. The check valve 60 is in the closed configuration due to the sealing member 64 being biased in its sealing position.

As shown in FIG. 2, in order to charge the device 10, the vacuum plunger 52 and the fluid plunger 54 are moved upward by a user away from their lowermost positions. The upward movement of the vacuum plunger 52 creates a vacuum in the vacuum chamber 30, and the volume of the vacuum increases with greater upward movement of the vacuum plunger 30. The upward movement of the fluid plunger 54 creates a negative pressure which draws fluid 2 from the fluid reservoir 100 into the fluid chamber 40 against the sealing bias of the sealing member 64. That is, as the fluid plunger 54 is moved upward, the force applied by the fluid 2 in the fluid reservoir 100 to the sealing member 64 is sufficient to overcome the sealing bias force of the sealing member 64. Thus, the sealing member 64 moves into its unsealing position, thereby allowing the fluid 2 to flow from the fluid reservoir 100 into the fluid chamber 40. The amount of the fluid 2 that enters the fluid chamber 40 increases with increased upward movement of the fluid plunger 54.

When charging the device 10, upward movement of the vacuum plunger 30 and the fluid plunger 40 can be stopped when the vacuum plunger 30 and the fluid plunger 40 reach their uppermost positions corresponding to the fully charged state of the device 10 shown in FIG. 3, or at any intermediate positions (e.g., the position shown in FIG. 2) of the vacuum plunger 30 and the fluid plunger 40 between their lowermost positions and their uppermost positions. When the vacuum plunger 30 and the fluid plunger 40 are in the intermediate positions, the device 10 is considered to be in a partially charged state.

When the device 10 is in a charged state and the user stops moving the vacuum plunger 30 and the fluid plunger 40, the sealing member 64 returns to the sealing position under its bias force, thereby placing the check valve 60 in the closed configuration and restricting flow of the fluid 2 from the fluid chamber 40 to the fluid reservoir 100. The vacuum in the vacuum chamber 30 applies a force $F_v$ to the vacuum plunger 52 in a first direction. Due to its connection with the fluid plunger 54, the vacuum plunger 52 transmits the force $F_v$ to the fluid plunger 54. As a result, the fluid plunger 54 applies a force $F_o$, in the first direction, to the fluid 2 in the fluid chamber 40, thereby "charging" or pressurizing the fluid 2 in the fluid chamber 40 such that the fluid 2 can be selectively output from the fluid chamber 40 through the fluid outlet 90 to an outside of the device 10 under the force $F_o$.

The fluid 2 is prevented from being output from the fluid chamber 40 through the fluid outlet 90 while the outlet valve 92 remains closed. When the outlet valve 92 is actuated and thereby opened by a user, the fluid 2 may be sprayed or otherwise output through the fluid outlet 92 at a predetermined flow rate. More specifically, when the outlet valve 92 is opened, the fluid 2 may be continuously sprayed or otherwise output through the fluid outlet 92 under the force $F_o$ applied by the fluid plunger 54 as the fluid plunger 54 is urged downward by the force $F_v$ generated by the vacuum in the vacuum chamber 30. While the fluid 2 is output through the fluid outlet 92, the vacuum plunger 30 and the fluid plunger 40 move downward towards their lowermost positions. The fluid 2 may be output through the fluid outlet 90 until the vacuum is depleted in the vacuum chamber 30 and the fluid 2 is depleted in the fluid chamber, or until the outlet valve 92 is closed. Once the outlet valve 92 is closed, the fluid 2 is no longer output through the fluid outlet 90. When the vacuum is depleted in the vacuum chamber 30 and the fluid 2 is depleted in the fluid chamber, the vacuum plunger 52 and the fluid plunger 54 are returned to their lowermost positions such that the device 10 is in the uncharged state.

When conventional vacuum-driven fluid delivery devices are stored (i.e., not operated) in a charged state, problems can occur. One such problem is that external gases from the surrounding environment can permeated into the vacuum chamber over time and occupy some or all of the volume initially containing the vacuum. Thus, the maximum volume of the vacuum in the vacuum chamber can decrease over time. Since the maximum duration of fluid output (e.g., spray) from the fluid outlet is determined by the volume of the vacuum in the vacuum chamber, a decrease in the maximum volume of the vacuum adversely affects performance of the device.

Additionally, when conventional vacuum-driven fluid delivery devices are stored in a charged state, the forces ($F_v$, $F_o$) generated by the vacuum in the vacuum chamber can place excessive stresses on the components of the device, causing the components to become damaged, deform or break when subjected to the vacuum over an extended period of time. Furthermore, according to examples, some or all of the components of vacuum-driven fluid delivery devices are constructed of thermoplastic materials, which suffer from creep when subjected to loading/stress over a sufficient period of time.

In order to avoid the above-described problems, the flow control member 70 is configured to allow the vacuum in the vacuum chamber 30 to slowly decrease when the device 10 is stored in a charged state by allowing a slow, controlled flow of the fluid 2 in the fluid chamber 40 into the fluid reservoir 100, as indicated above. More specifically, as the fluid 2 flows from the fluid chamber 40 to the fluid reservoir 100 through the gap or passage in the flow control member 70, the vacuum plunger 52 and the fluid plunger 54 move towards their lowermost positions and the volumes of the vacuum chamber 30 and fluid chamber 40 slowly decrease. If the device 10 is stored for a sufficient period of time, the vacuum plunger 52 and the fluid plunger 54 will return towards their lowermost positions, placing the device 10 in the uncharged state (shown in FIG. 1) in which the vacuum chamber 30 and fluid chamber 40 have volumes of zero. Thus, external gases are prevented from permeating into the vacuum chamber 30 and stresses on the components of the device 10 due to charging are relieved.

Although the foregoing description relates to an example in which the fluid plunger 54 is driven by a vacuum in the vacuum chamber 30, the fluid plunger 54 may alternatively be driven by a power spring (not shown) in a known manner. That is, a power spring may provide a biasing force in the downward direction such that movement of the fluid plunder 54 in the upward direction to charge the device results in the power spring applying a downward force to the fluid plunger 54, and the fluid plunger applies the force $F_o$ to the fluid 2 in the fluid chamber 40. In such an example employing a power spring, the flow control member 70 provides the benefit of relieving stresses on the components of the device due to charging by allowing the fluid in the fluid chamber 40 to slowly return to the fluid reservoir 100 when the device is stored in a charged configuration.

Words describing relative spatial relationships, such as "below", "beneath", "under", "lower", "bottom", "above", "over", "upper", "top", "left", and "right", "upward", "downward", "uppermost" and "lowermost" may be used to conveniently describe spatial relationships of one device or elements with other devices or elements. Such words are to be interpreted as encompassing a device oriented as illustrated in the drawings, and in other orientations in use or operation. For example, an example in which an element of a device is described as moving upward also encompasses the element moving downward when the device is flipped upside down in use or operation.

While this disclosure includes specific examples, it will be apparent that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system or device are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A fluid delivery device, comprising:

a first chamber configured to receive fluid from a fluid reservoir through a first valve;

a second chamber configured to generate a vacuum therein to apply a force generated by the vacuum to the fluid in the first chamber to cause the fluid in the first chamber to be output from the fluid delivery device through an outlet valve of the first chamber when the outlet valve is open; and a flow control valve configured to allow the fluid in the first chamber to flow through the flow control valve into the fluid reservoir at a predetermined flow rate, when the first valve and the outlet valve are closed, to decrease the vacuum in the second chamber.

2. The fluid delivery device of claim 1, wherein the flow control valve comprises a fixed position valve.

3. The fluid delivery device of claim 2, wherein the fixed position valve is fixed in a closed position in which a flow of the fluid in the first chamber into the fluid reservoir through the fixed position valve is only partially restricted.

4. A fluid delivery device, comprising:

a first chamber;

a second chamber;

a reservoir configured to contain a fluid;

a first valve configured to control a first flow of the fluid between the fluid reservoir and the second chamber;

a flow control valve configured to control a second flow of the fluid between the second chamber and the fluid reservoir, a first plunger configured to generate a vacuum in the first chamber responsive to movement of the first plunger in a first direction; and a second plunger configured to move in the first direction in response to movement of the first plunger in the first direction to cause a portion of the fluid to flow from the fluid reservoir through the first valve and into the second chamber, and configured to apply a force generated by the vacuum to the portion of the fluid in the second chamber; and an outlet comprising a second valve configured to be actuated to output the portion of the fluid from the second chamber outside of the fluid delivery device, wherein, when the second valve is not actuated and the first valve is closed, the flow control valve is configured to allow the portion of the fluid in the second chamber to flow through the flow control valve into the fluid reservoir at a predetermined flow rate.

5. The fluid delivery device of claim 4, wherein when the flow control valve is in a closed configuration, the flow control valve only partially blocks a flow of the portion of the fluid in the second chamber from the second chamber to the fluid reservoir.

6. The fluid delivery device of claim 5, wherein the flow control valve comprises a fixed position valve.

7. The fluid delivery device of claim 4, wherein:

the first valve is configured to prevent the portion of the fluid in the second chamber from flowing out of the second chamber through the first valve; and when the second valve is not actuated, the second valve is biased to prevent the portion of the fluid in the second chamber from flowing out of the second chamber through the second valve.

8. The fluid delivery device of claim 7, wherein, in response to the portion of the fluid in the second chamber flowing through the flow control valve into the fluid reservoir, the first plunger and the second plunger move in a second direction opposite the first direction and the vacuum in the first chamber decreases.

* * * * *